US011443863B2

(12) United States Patent
Sempere Belda et al.

(10) Patent No.: US 11,443,863 B2
(45) Date of Patent: Sep. 13, 2022

(54) METHOD FOR DECONTAMINATING METAL SURFACES OF A NUCLEAR FACILITY

(71) Applicant: Framatome GmbH, Erlangen (DE)

(72) Inventors: Luis Sempere Belda, Erlangen (DE); Jose Pedro Moreira Do Amaral, Erlangen (DE); Christian Topf, Forchheim (DE)

(73) Assignee: FRAMATOME GMBH, Erlangen (DE)

( * ) Notice: Subject to any disclaimer, the term of this patent is extended or adjusted under 35 U.S.C. 154(b) by 940 days.

(21) Appl. No.: 16/306,367

(22) PCT Filed: Jan. 8, 2018

(86) PCT No.: PCT/EP2018/050322
§ 371 (c)(1),
(2) Date: Nov. 30, 2018

(87) PCT Pub. No.: WO2018/134067
PCT Pub. Date: Jul. 26, 2018

(65) Prior Publication Data

US 2021/0225543 A1 Jul. 22, 2021

(30) Foreign Application Priority Data

Jan. 19, 2017 (WO) ..... PCT/EP2017/051043

(51) Int. Cl.
*G21F 9/00* (2006.01)
*G21F 9/30* (2006.01)

(52) U.S. Cl.
CPC ..... *G21F 9/004* (2013.01); *G21F 9/30* (2013.01)

(58) Field of Classification Search
CPC ..... G21F 9/00; G21F 9/004; G21F 9/30
USPC ..... 134/3
See application file for complete search history.

(56) References Cited

U.S. PATENT DOCUMENTS

| | | | |
|---|---|---|---|
| 4,287,002 | A | 9/1981 | Torok |
| 4,756,768 | A | 7/1988 | Bertholdt et al. |
| 2014/0352717 | A1 | 12/2014 | Bertholdt et al. |

FOREIGN PATENT DOCUMENTS

| | | | |
|---|---|---|---|
| EP | 0090512 | A1 | 10/1983 |
| EP | 134664 | B1 | 11/1988 |
| EP | 1220233 | B1 | 1/2010 |
| EP | 1054413 | B1 | 7/2013 |
| EP | 2758966 | B1 | 3/2016 |
| EP | 2923360 | B1 | 4/2016 |

OTHER PUBLICATIONS

PCT International Search Report and Written Opinion dated Mar. 28, 2018 in Application No. PCT/EP2018/050322, 13 pages.

*Primary Examiner* — Edward M Johnson
(74) *Attorney, Agent, or Firm* — Dilworth IP, LLC

(57) ABSTRACT

A method for decontaminating a metal surface exposed to radioactive liquid or gas during operation of a nuclear facility comprises an oxidation step wherein a metal oxide layer on the metal surface is contacted with an aqueous oxidation solution comprising a permanganate oxidant for converting chromium into a Cr(VI) compound and dissolving the Cr(VI) compound in the oxidation solution; and a first cleaning step wherein the oxidation solution containing the Cr(VI) compound is directly passed over an anion exchange material and the Cr(VI) compound is immobilized on the anion exchange material. The method provides for substantial savings of radioactive waste and produces chelate-free waste.

21 Claims, No Drawings

METHOD FOR DECONTAMINATING METAL SURFACES OF A NUCLEAR FACILITY

TECHNICAL FIELD OF THE INVENTION

The invention relates to a method for decontaminating a metal surface exposed to radioactive liquid or gas during operation of a nuclear facility, and in particular to a method for decontaminating a metal surface in the primary circuit of a nuclear reactor wherein the metal surface is covered with a radioactive metal oxide layer including chromium.

BACKGROUND OF THE INVENTION

The piping of a nuclear reactor is usually made of stainless steel or carbon steel. The steam generator tubes and main surfaces inside the primary circuit may include nickel alloys. When the nuclear reactor is operated, metal ions are released from these metal surfaces and transported into the coolant. Some of the metal ions are activated to form radioisotopes when passing the reactor core. A portion of the metal ions and radioisotopes is removed by the reactor water clean-up system (RWCU) during operation of the reactor. Another portion is deposited on the metal surfaces inside the reactor cooling system, and is later incorporated into metal oxide layers growing on the metal surfaces. Through the incorporation of radionuclides, these oxide layers become radioactive. The removal of the radioactive oxide layers is often necessary to reduce the level of personnel radiation exposure prior to carrying out inspection, maintenance, repair and dismantling procedures on the reactor cooling system.

Depending on the type of alloy used for a component or system, the metal oxide layers contain mixed iron oxides with divalent and trivalent iron as well as other metal oxide species including chromium(III) and nickel(II) spinels. Especially the oxide deposits formed on the metal surfaces of the steam generator tubes may have a high Cr(III) or Ni(II) content which makes them very resistant and difficult to remove from the metal surfaces.

Many procedures are described to remove metal oxide layers containing radioactive corrosion products from metal surfaces in the cooling system of a nuclear reactor. A commercially successful method is known as HP CORD UV and comprises the steps of treating the metal oxide layer with an aqueous solution of a permanganate oxidant in order to convert Cr(III) to Cr(VI), and subsequently dissolving the metal oxide layer under acidic conditions using an aqueous solution of an organic acid such as oxalic acid. The organic acid additionally serves to reduce a possible excess of the permanganate oxidant originating from the preceding oxidation step, and to reduce Cr(VI) dissolved in the oxidant solution to Cr(III). Additional or alternative reducing agents can be added for removing the permanganate oxidant and converting Cr(VI) to Cr(III).

In a subsequent cleaning step, the decontamination solution containing the organic acid and corrosion products including metal ions and radioisotopes originating from the metal oxide layer, such as Fe(II), Fe(III), Ni(II), Co(II), Co(III) and Cr(III), is then passed through an ion exchange resin to remove the radioisotopes and some or all of the metal ions from the decontamination solution. The organic acid in the decontamination solution can be exposed to UV radiation and decomposed by photocatalytical oxidation to form carbon dioxide and water, thereby minimizing the amount of radioactive waste generated by the decontamination treatment.

Ion exchange resin waste is commonly generated during the cleaning step as a result of removing the corrosion products from the decontamination solution. Depending on the corrosion products, cation and/or anion exchange resins are used to purify the decontamination solution. If chromium is present in the decontamination solution, the solution will initially contain anionic chromium complexes such as chromium oxalate $Cr(III)(C_2O_4)_3^{3-}$. If the photocatalytical decomposition step is prolonged for sufficient time, the decontamination solution may also contain inorganic chromium compounds such as chromate salts $Cr(VI)O_4^{2-}$. However, chromium oxalate is an extremely stable chelate complex, and it is often not possible to achieve a complete decomposition of the oxalate within the constraints of an industrial scale chemical decontamination application using this method alone. The anionic chromium complexes are picked up at the end of the cleaning step by the anion exchange resin as soon as the decontamination solution is depleted of free oxalic acid by photocatalytical oxidation, but before complete decomposition of the amount of oxalic acid bound in the chromium oxalate complex. Oxalic acid, or other organic acids and chelating agents employed in decontamination methods comparable to the one described above, may also be absorbed by the anion exchange resin, resulting in the presence of a substantial amount of the chelating agent in the final waste resin matrix. This may be undesirable in some jurisdictions for technical reasons or due to existing regulations.

A further analysis of the published prior art reveals that processes for the removal of chromium in an inorganic non-chelated state during a chemical decontamination treatment of a nuclear facility have been proposed. Many of these processes employ ozone as an oxidizing agent for the oxidation of chromium in the oxide layers.

For example, EP 1 054 413 B1 relates to a method of chemically decontaminating components of a radioactive material handling facility. Ozone gas having a high ozone concentration is generated by an electrolytic process. An ozone solution is prepared by injecting the ozone gas into an acidic solution of pH 6 or below. The ozone solution heated at a temperature in the range of 50° to 90° C. is supplied to a contaminated object to oxidize and dissolve a chromium oxide film by an oxidizing dissolving process. The ozone solution used in the oxidizing dissolving process is irradiated with ultraviolet rays to decompose ozone contained in the ozone solution, and the solution is passed through an ion-exchange resin to remove chromate ions contained in the ozone solution. Subsequently, an oxalic acid solution is supplied to the contaminated object to dissolve an iron oxide film by a reductive dissolving process. Oxalic acid remaining in the oxalic acid solution after the reductive dissolving process is decomposed by injecting ozone into the oxalic acid solution and irradiating the oxalic acid solution with ultraviolet rays, and ions contained in the oxalic acid solution are removed by an ion-exchange resin.

EP 1 220 233 B1 directed to a chemical decontamination method for dissolving an oxide film adhered to a contaminated component. The method comprises the steps of preparing a decontamination solution in which ozone is dissolved and an oxidation additive agent is added, which suppresses corrosion of a metal base of the contaminated component, and applying the decontamination solution to the contaminated component, thereby to remove the oxide film by oxidation. The chromate ions formed in this step are captured on an anion exchange resin. However, the oxidation step is performed only after a reduction decontamination step using oxalic acid.

EP 2 758 966 B1 relates to a method for decomposing an oxide layer containing chromium, iron, nickel, and radionuclides by means of an aqueous oxidative decontamination solution, which contains permanganic acid and a mineral acid, and which flows in a circuit, wherein the oxidative decontamination solution is set to a pH value 2.5. The decontamination solution is repeatedly passed through a cation exchange material for removing radioactive matter dissolved from the oxide layer, and is subsequently passed through an anion exchange resin to immobilize chromate ions formed during the oxidative decontamination step and regenerating the mineral acid. The method does not make use of any organic acid for dissolving metal oxide deposits other than hematite.

U.S. Pat. No. 4,287,002 A relates to a method of decontaminating and removing corrosion products at least some of which are radioactive, from nuclear reactor surfaces exposed to coolant or moderator, said surfaces containing acid-insoluble metal oxides, including chromium oxide. The surfaces are decontaminated by treating the surface with ozone to oxidize acid-insoluble metal oxides to a more soluble state, removing oxidized solubilized metal oxides, and removing other surface oxides using low concentrations of decontaminating reagents. Chromic acid dissolved from the surfaces may be removed from the circulating water by contacting the solution with an anion exchange resin.

EP 134 664 B1 is directed to a process for oxidizing chromium in deposits in the cooling system of a nuclear reactor using a solution of ozone, which consists of adding to the solution from 0.01 to 0.5% of a water-soluble cerium (IV) compound, from 0.1 to 0.5% of a water-soluble aromatic compound having at least one ketone group on an aromatic ring, or adding both. A process for decontaminating the cooling system of nuclear reactors comprises adding a decontamination composition to the coolant, circulating the coolant between the cooling system and a cation exchange resin, removing the decontamination composition by passing it through an anion exchange resin, adjusting the temperature to 40 to 100° C., adding the ozone oxidation composition, circulating the coolant through the cooling system, raising the temperature to at least 100° C., passing the coolant through an anion exchange resin or a mixed resin, adjusting the temperature to from 60 to 100° C. and repeating the addition of the decontamination composition and its removal.

Due to the extremely limited half-life of ozone in water, ozone-based processes have proved as being ineffective for the decontamination of chromium rich oxide layers on a large scale, such for full system decontamination (FSD) of PWR (pressurized water reactor) type nuclear power plants. Processes trying to overcome this limitation of ozone through use of auxiliary substances, such as the use of cerium(IV) as a reaction intermediary, suffer from a greatly increased radioactive waste amount produced due to the auxiliary chemicals. These chemicals may also include nitrates or sulfates, which are either undesirable in the radioactive waste and/or raise compatibility concerns towards many of the materials present in primary circuit and auxiliary systems of the nuclear power plant. In addition, most of these processes involve a subsequent treatment with organic acids, in which chromium is present in a chelated state anyway.

However, the main disadvantage of the ozone based processes is the use of ozone itself. Use of ozone in the oxidation step is costly and requires additional separate dosage stations and equipment since the ozone must be prepared on-site and cannot be stored in stock solutions at the nuclear facility. A further disadvantage of ozone is its nature as a toxic, even poisonous gas. Use of ozone in the closed containment of a nuclear power plant is therefore categorized as a safety risk and undesirable hazard. For this reason, liquid or non-gaseous alternatives are greatly preferred, which drastically reduce or completely eliminate the risk of gas poisoning for the involved personnel.

The prior art processes using other oxidants present in the liquid phase are suitable to avoid the disadvantages of gaseous ozone. However, these processes are not optimized for waste reduction in a large scale application while making use of chromium removal in an inorganic, chelate-free stage.

EP 2 923 360 B1 discloses a method for the chemical decontamination of a surface of a metal component having an oxide layer in the coolant system of a nuclear power plant. The method comprises at least one oxidation step in which the oxide layer is treated with an aqueous oxidizing solution, and a subsequent decontamination step, wherein the oxide layer is treated with an aqueous solution of an organic acid. The organic acid is capable of forming complexes with metal ions, especially nickel ions, in the form of a sparingly soluble precipitate. Prior to performing the decontamination step, metal ions such as Ni(II) are removed from the oxidizing solution using a cation exchange resin.

While this process uses permanganate as an oxidizing agent, the removal of chromium in a chelate-free inorganic state is not taken into consideration. Rather, chromium released during the oxidation treatment is assimilated to the chromium released during the organic acid treatment which in all cases is present as a chelate complex.

EP 090 512 A1 discloses a method of oxidizing chromium-containing corrosion products deposited on internal surfaces of a piping system through which an aqueous fluid is circulating. The method comprises the steps of adding to said circulating fluid a ferrate (VI) salt to form a dilute ferrate solution, while maintaining a pH of between 7 and 14, said ferrate reacting with chromium compounds contained in said corrosion products to form a chromate. The fluid is regenerated in situ by passing the fluid through an ion exchange resin to remove the products formed in the oxidation reaction and unreacted ferrate (VI). After the regeneration of the fluid, a CAN-DECON™ decontamination process may follow.

According to this process, chromium is removed in an inorganic non-chelated state. However, the process generates much higher amounts of radioactive waste than a permanganate-based process, due to higher amount of oxidants employed and the auxiliary chemicals required to maintain the pH of the ferrate solution, while providing less satisfactory decontamination results than permanganate-based treatments and being more corrosive. The subsequent treatment of the surfaces with a CAN-DECON solution is proposed as an option, but is necessary to achieve an acceptable decontamination effect. Use of the CAN-DECON solution again results in the generation of chromium in a chelated state.

The inventors therefore contemplate that the HP CORD UV process, or similar processes based on permanganate oxidation solutions, constitute the starting point and benchmark for the development of any improved processes for the decontamination of metal surfaces in a nuclear facility, such as the primary circuit of a nuclear reactor, wherein the metal surface is covered with a radioactive metal oxide layer including chromium. The examination of the prior art reveals that there is no single process for removal of chromium in an inorganic chelate-free state which is optimized for application at an FSD scale. In fact, the prior art processes are either more corrosive, or riskier through the use of poisonous gas, or produce more waste. None of these processes would be more effective and quicker for a chemical decontamination application than the known permanganate-based HP CORD UV process, and none would be able to guarantee the efficient removal of chromium in a chelate-free state.

SUMMARY OF THE INVENTION

It is therefore an object of the present invention to provide a cost effective decontamination method for a nuclear facility and its components suitable for applications up to a Full System Decontamination scale which allows for savings of radioactive waste and also savings of time for the decontamination treatment cycles.

As a further object, the invention aims at providing a decontamination method which generates chelate free ion exchange material waste after chemical decontamination of the primary cooling system or its components of a nuclear power plant.

These objects are solved by a decontamination method according to claim 1. Advantageous and expedient embodiments of the invention are indicated in the dependent claims which can be combined with each other independently.

In one aspect, the invention provides a method for decontaminating a metal surface exposed to radioactive liquid or gas during operation of a nuclear facility, wherein the metal surface is covered with a metal oxide layer including chromium and radioactive matter, the method comprising:

a) an oxidation step wherein the metal oxide layer is contacted with an aqueous oxidation solution for converting chromium into a Cr(VI) compound and dissolving the Cr(VI) compound in the oxidation solution, wherein the aqueous oxidation solution comprises a permanganate oxidant but no additional mineral acid;

b) a first cleaning step wherein the aqueous oxidation solution containing the Cr(VI) compound is passed directly over an anion exchange material and the Cr(VI) compound is immobilized on the anion exchange material;

c) a decontamination step following the first cleaning step wherein the metal oxide layer subjected to the oxidation step is contacted with an aqueous solution of an organic acid for dissolving the metal oxide layer, thereby forming a decontamination solution containing the organic acid, metal ions and radioactive matter, and wherein the decontamination solution is passed over a cation exchange material for immobilizing the metal ions and radioactive matter;

d) a second cleaning step wherein the organic acid contained in the decontamination solution is decomposed; and e) optionally repeating steps a) to d).

The present invention provides a safe and reliable chemical decontamination process that can be applied at an industrial scale up to full system decontamination (FSD), including the simultaneous treatment of a complete primary coolant circuit including auxiliary systems of a nuclear power plant, and that guarantees the absence of chelating agents originating from the decontamination chemicals in the resulting radioactive waste as well as the absence of corrosive mineral acids. The amount of radioactive waste generated as a result of the decontamination treatment is furthermore kept as low as possible to reduce the high disposal costs involved.

The inventors contemplate that one of the key factors for solving the above problem consists in achieving a chemical state for chromium, in which it can be completely removed from the process solution in an inorganic non-chelated state. One viable option is the removal of chromium as a Cr(VI) compound such as chromate.

The decontamination method of the present invention avoids the presence of a substantial amount of organic anionic chromium complexes in the second cleaning step which would have to be picked up by an anion exchange material, and which would then create additional resin waste due to the presence of a chelating agent such as an organic acid. Since chromium is removed already at the end of or during the oxidation step, only a residual amount of chromium complexes such as chromium oxalate is present in the second cleaning step at the end of the decontamination treatment cycle. This residual amount of organic anionic chromium complexes can be decomposed in a considerably shorter time using a suitable technology such as the described photocatalytical decomposition, or preferably can be transferred to the next treatment cycle starting with the oxidation step, wherein the chelating agent is completely decomposed very effectively and in a very short time by the permanganate oxidant. During the same process any chelated Cr(III) is converted to a Cr(VI) compound, that can then be removed from solution in a chelate-free state in the following cleaning step.

A combination of both techniques can also be employed, wherein the amount of organic acid is first reduced using a technology such as photocatalytical decomposition, and the residual amount of chromium complexes is subsequently decomposed by adding the oxidation solution comprising a permanganate oxidant. This combination results in a faster treatment than the photocatalytical decomposition technology alone, and produces less additional waste as if the chromium chelate complexes were decomposed by adding only the permanganate-based oxidation solution. Accordingly, the potential presence of organic anionic chromium complexes at the end of the decontamination treatment cycle has only minimal impact on the waste produced during the treatment cycle.

The method according to the invention guarantees that no organic acids or chelating agents are present in the spent ion exchange material waste. According to a preferred embodiment, this can be ensured either through sluicing of the ion exchange material immediately after its use and before any injection of chelating substances has taken place, or through other methods or technical restrictions such as appropriate valve positioning, so that the ion exchange material is not exposed to an organic acid solution at a later stage of the decontamination process.

Moreover, when chromium is removed from the process in the form of a Cr(VI) compound such as a chromate or dichromate at the end of or during the oxidation step, the consumption of anion exchange material is considerably lower as compared to removal of chromium complexes. The Cr(VI) compound is picked up by the anion exchange material as only one equivalent per chromium atom, instead of three equivalents in the case of e.g. chromium(III) trioxalate. In a practical example, this means a consumption of only 100 L of anion exchange material as compared to up to 300 L according to the prior art decontamination process, for the same amount of chromium removed.

Further, since regulatory provisions in some countries limit the total amount of chelating agents in the radioactive waste, the commercial prior art process may require a decomposition of the chromium complexes during the final cleaning step, for example by photocatalytical oxidation. This additional decomposition step requires a considerable amount of time which may range from hours to days per treatment cycle. In contrast thereto, the inventive process allows for considerable time savings because the amount of chromium complexes at this stage is lower due to the removal of a large fraction of the chromium as a Cr(VI) compound before the injection of the chelating acids, and because any residual amount of chromium present in the decontamination solution after the cleaning step can be transferred to the next decontamination cycle. At the start of the next cycle, chromium is again oxidized within minutes to form a Cr(VI) compound, which is then captured in an inorganic chelate-free state.

In a second aspect, the invention provides a method of reducing an amount of spent ion exchange material waste from decontamination of a metal surface exposed to radioactive liquid or gas, wherein the metal surface is covered with a metal oxide layer including chromium and radioactive matter, and wherein the decontamination comprises a plurality of treatment cycles, each treatment cycle comprising:

an oxidation step to convert chromium in the metal oxide layer to a Cr(IV) compound;

a first cleaning step wherein a substantial amount of the Cr(VI) compound is immobilized on an anion exchange material without contacting the anion exchange material with a chelating organic acid; and a decontamination step following the first cleaning step wherein a decontamination solution comprising an organic acid and metal ions dissolved from the metal oxide layer is passed over a cation exchange resin for immobilizing the metal ions;

wherein any chelated chromium contained in the decontamination solution is carried to the oxidation step of a following treatment cycle.

The inventors contemplate that the inventive decontamination method results in a reduction of spent ion exchange material waste of greater than 20 percent by volume as compared to a decontamination method including a step of contacting the Cr(VI) compound with a chelating organic acid, preferably greater than 30 percent, and more preferably 30 to 40 percent.

Preferably, in both aspects of the invention, the anion exchange material is an inorganic anion exchange material. Use of an inorganic anion exchange material is made possible through the removal of chromium in an inorganic non-chelated state and through the absence of an organic acid. Use of an inorganic anion exchange material has not been reported so far for any large scale chemical decontamination applications due to its incompatibility with organic acids.

Furthermore, use of an inorganic anion exchange material also enables the removal of permanganate from the process solution through ion exchange mechanisms, instead of requiring reduction of permanganate to manganese in a lower oxidation state which is then either filtered out or removed from the process solution via cation exchange. The removal of permanganate prior to the decontamination step using an inorganic anion exchange material results in additional waste savings of greater than 30 percent as compared to the removal of manganese via cation exchange. Additional waste savings of preferably greater than 40 percent, and more preferably greater than 60 percent and more can be achieved in this way. Moreover, removal of residual permanganate on an ion exchange material instead of reducing it through the addition of an organic acid may also avoid emissions of gaseous carbon dioxide from decomposition of the organic acid.

Preferably, the Cr(VI) compound has a greater affinity towards said anion exchange material than permanganate. More preferably, the affinity of the Cr(VI) compound to the, preferably inorganic, anion exchange material is between five to ten times higher than the affinity of permanganate. The higher affinity of the Cr(VI) compound allows for separating Cr(VI) from permanganate during the course of the decontamination process, by limiting the amount of anion exchange material available for bonding chromium.

This feature of the decontamination method may be of particular interest for nuclear power plants in operation, or close to the operational period, due to the higher contents of radioactive chromium-51 present then. The possibility of separating radioactive chromium compounds in a waste fraction having a high activity content from a permanganate waste fraction having a much lower activity content can have considerable advantages with respect to waste disposal, depending on applicable regulations on the site.

The amount of anion exchange material required for bonding the total amount of chromium present in the oxidation step can be determined based on the amount of chromium analyzed in the oxidation solution. Permanganate initially fixed on the anion exchange material is displaced by the Cr(VI) compound when it arrives at the ion exchanger. The selectivity of the anion exchange material towards the chromium compound makes it possible to remove the Cr(VI) compound from the oxidation solution while maintaining a permanganate concentration at a sufficiently high level to enable the oxidation process to continue.

Thus, in a preferred embodiment, the first cleaning step can be started already during the oxidation step so that the oxidation step and the first cleaning step are at least partially conducted simultaneously. This can be used to achieve additional time savings.

Preferably, the oxidation solution containing the Cr(VI) compound and the permanganate oxidant is passed over the anion exchange material, preferably an inorganic anion exchange material, and at least the Cr(VI) compound is immobilized on the anion exchange material. More preferably, the oxidation solution is passed over the anion exchange material before a concentration of the Cr(IV) in the oxidation solution has stabilized at an essentially constant level.

The construction and method of operation of the invention together with additional objects and advantages thereof will be best understood from the following description of specific embodiments which are given for illustrative purposes only and which are not intended to limit the scope of the present invention.

DETAILED DESCRIPTION OF THE INVENTION

According to the method of the present invention, a metal oxide layer containing radioisotopes is effectively removed from metal surfaces of a nuclear facility, and in particular from metal surfaces located in the primary cooling system of a nuclear reactor. The primary cooling system is understood as comprising all systems and components which are in contact with the primary coolant during reactor operation, including but not limited to the reactor vessel, reactor coolant pumps, pipework and steam generators, as well as auxiliary systems such as the volume control system, pressure reducing station and reactor water clean-up system.

The decontamination method of the present invention is particularly useful for decontamination of the primary cooling system or components thereof in a boiling water reactor or a pressurized water reactor, and preferably a nuclear reactor comprising steam generator piping having metal surfaces of nickel alloys such as Inconel™ 600, Inconel™ 690 or Incoloy™ 800, and/or materials with a high chromium content, or large surfaces of chromium containing materials.

The inventors contemplate that the method of the present invention can also be used for decontamination of the coolant and/or moderator circuit of a heavy water reactor such as a CANDU™ nuclear reactor or any other heavy water reactors, but is not limited to these reactor types.

The decontamination treatment can be carried out on reactor subsystems and components. Preferably, the decontamination method of the present invention is carried out as full system decontamination. During full system decontamination the contaminated metal oxide layer is removed from all metal surfaces in the reactor cooling system that are in contact with the primary coolant during reactor operation. Typically, full system decontamination involves all parts of the primary coolant circuit and the steam generator as well as the volume control system, the pressure reducing station and possibly other systems which are contaminated to a certain extent.

According to a preferred embodiment, the decontamination method can be applied using an external decontamination equipment for injection of decontamination chemicals, for monitoring the decontamination treatment, for increasing the available ion exchange rate, and for achieving the decontamination targets in a faster, more economical and safer way. The process temperatures are preferably kept below the boiling point of water at atmospheric pressure in order to eliminate the need of using complex and expensive pressure-proof components for the external decontamination equipment.

The chemicals used for the decontamination treatment can be injected into the primary coolant circuit of the nuclear reactor at a dosing station located in the low-pressure part of the coolant circuit. Preferably, the external decontamination equipment is used for dosing the decontamination chemicals.

Ion exchange materials and chemicals used in the decontamination method of the present invention are commercially available and can be held in stock at the nuclear power plant facilities.

In general, one or more decontamination treatment cycles are carried out in order to achieve a satisfactory reduction of activity on the metal surfaces. The reduction of surface activity and/or the dose reduction correlating to surface activity reduction is referred to as "decontamination factor". The decontamination factor is calculated either by the specific surface activity before decontamination treatment divided by the specific surface activity after the decontamination treatment, or by the dose rate before decontamination treatment divided by the dose rate after decontamination treatment.

Preferably, the decontamination factor of a technically satisfying decontamination treatment is greater than 10.

The various steps of the decontamination method of the present invention are now described in greater detail below.

Oxidation Step

For carrying out the oxidation step, an aqueous solution of the permanganate oxidant is injected into the primary coolant within the primary coolant circuit or the subsystem which is to be decontaminated, and the aqueous oxidation solution comprising the permanganate oxidant is circulated through the system. Preferably, the permanganate oxidant is injected into a low-pressure section of the cooling and/or moderator system. Examples for suitable injection positions are the volume control system, the reactor water cleanup system and/or a residual heat removal system. More preferably, the solution of the permanganate oxidant can be introduced into the primary cooling system or moderator system by means of an external decontamination device.

The oxidation step is carried out as a mere pre-oxidation step. Thus, during the oxidation step, the metal oxide layer substantially remains on the metal surface to be decontaminated, and no activity is removed from the system to be decontaminated. Rather, the permanganate oxidant acid reacts with spinel-type metal oxides in the metal oxide layer which are almost inert to organic acids to break up the oxide structure and convert the spinel-type metal oxides into more soluble oxides. Cr(III) in the metal oxide layer is oxidized to form soluble Cr(VI) compounds, and the Cr(VI) compounds are dissolved in the permanganate-based oxidation solution. Depending on the pH value of the oxidation solution, the Cr(VI) compound may comprise chromic acid, dichromic acid and/or salts thereof.

Preferably, the permanganate oxidant is selected from permanganic acid, $HMnO_4$, and alkali metal permanganate, optionally in combination with an alkali metal hydroxide. Permanganic acid is preferred over alkali metal permanganate salts because less waste is produced. Depending on the nature of the metal oxide layer, however, an alkaline oxidation solution may also be used for oxidizing the metal oxide layer. The alkaline oxidation solution may include an alkali metal permanganate salt such as sodium or potassium permanganate, as well as an alkali metal hydroxide. It may also be useful to switch between acidic oxidation conditions and alkaline oxidation conditions in the oxidation steps of subsequent decontamination treatment cycles.

Still more preferably, the permanganic acid is prepared on demand by ion exchange reaction between an alkali metal permanganate salt and a cation exchange resin. The permanganic acid can be prepared on site, or can be provided as an aqueous stock solution having a concentration of from 1 to 45 g/L, preferably a concentration of from 30 to 40 g/L.

According to the invention, no additional mineral acid such as sulfuric acid, nitric acid, hydrochloric acid or phosphoric acid is added to the oxidation solution. Preferably, the pH of the oxidation solution is kept at or above 2.5 which can be achieved using permanganic acid as the sole oxidant. Carrying out of the oxidation step at a pH>2.5 can avoid substantial corrosion of the metal surface to be decontaminated. In addition, the absence of an additional mineral acid in the oxidation solution avoids too high dissolution rates of the metal oxide layer which could be detrimental in FSD operations.

Preferably, the oxidation step is carried out at a temperature of between about 20 to 120° C., more preferably at a temperature of from 80 to 95° C. The oxidation step is faster at higher temperatures. Accordingly, higher oxidation temperatures are preferred. Moreover, the boiling point of an aqueous solution of permanganic acid under atmospheric pressure is higher than 95° C., which makes it easier to circulate the oxidation solution through the cooling system using the pumps of the external decontamination device.

However, it is also possible to carry out the oxidation step at temperatures of up to 120° C. at a higher than atmospheric pressure, with or without the use of an external decontamination device.

Preferably, the concentration of the permanganate oxidant in the oxidation solution within the primary cooling system is controlled to be in the range of from 10 to 800 mg/kg during the oxidation step, and preferably to range from 50 to 200 mg/kg. If the concentration of the permanganate oxidant in the oxidation solution is lower than 10 mg/kg, the reaction rate of the oxidation may be too low and several additional injections may be required. If the concentration of the permanganate oxidant in the oxidant solution exceeds 800 mg/kg, a large excess of the oxidant may be present at the end of the oxidation step which can generate an unnecessary amount of waste.

Preferably, the amount of the permanganate oxidant is controlled to be as low as possible at the end of the oxidation step because removal of excess permanganate oxidant will increase the amount of secondary waste.

Preferably, the progress of the oxidation step is monitored by controlling the amount of the permanganate oxidant remaining in the oxidation solution, and by monitoring the concentration of Cr(VI) dissolved in the permanganate-based oxidation solution. As long as the oxidation reaction continues and the oxidation of the metal oxide layer is incomplete, the permanganate oxidant continues to be consumed and, in most cases, the concentration of Cr(VI) compounds increases.

The residence time of the oxidation solution in the cooling system during the oxidation step may comprise a plurality of hours, preferably 30 hours or more in large and complex applications such as full system decontaminations. It is desired that the oxidation of the metal oxide layer is substantially complete so that as much as possible of the metal oxide layer thickness is reacted during the oxidation step.

Preferably, the oxidation step is terminated when no further increase of the Cr(VI) concentration in the oxidation solution can be determined, more preferably when the permanganate concentration in the oxidation solution has stabilized additionally at an essentially constant concentration level and permanganate oxidant is no longer being consumed, and most preferably when the permanganate oxidant has been completely consumed.

Instead of, or in addition to, monitoring the concentration of Cr(VI) and/or permanganate, it is also possible to monitor the presence of the radioisotope Cr-51 in the oxidation solution by means of gamma spectroscopy.

First Cleaning Step

In the first cleaning step, the aqueous oxidation solution containing the Cr(VI) compound is passed directly over an anion exchange material, before or after removal of the permanganate oxidant, in order to capture at least the chromate or dichromate ions present in the oxidation solution and optionally any excess of permanganate ions still contained in the oxidation solution. Passing the oxidation solution directly over an anion exchange material means that no cation exchange is performed during the first cleaning step or the oxidation step. Treating the oxidation solution by passing over a cation exchange material is not necessary in this stage of the decontamination process, since the amount of divalent metal ions or activity dissolved from the metal oxide layer in the oxidation solution is rather low.

Suitable anion exchange materials for use in the decontamination method of the present invention are resistant to the harsh oxidizing and optionally acidic conditions present in the oxidation solution. It is also possible to use different anion exchange materials or combinations of anion exchange materials each being optimized for the specific conditions in the different process steps. Anion exchange materials suitable for use in the decontamination method of the present invention are commercially available, such as Levatite™ M800 from Lanxess, Diaion SA 10AOH from Mitsubishi Chemicals or NRW 8000 from Purolite. The anion exchange materials can be included in the external decontamination device, and may be configured as membranes or ion exchange columns filled with the anion exchange material. Alternatively or additionally, the inventors contemplate use of the anion exchange materials which are present in the reactor water clean-up system or any other suitable internal system of the nuclear facility.

In a preferred embodiment of this invention, the anion exchange material is contained within an external module which is preferably configured for a prompt charge and discharge of different amounts of said material. More preferably, the external module is an integral part of the external decontamination equipment.

The first cleaning step is controlled by monitoring the removal of the Cr(VI) compound and/or the permanganate oxidant from the oxidation solution, preferably by photometric measurements, by determining the oxidation potential of the oxidation solution relative to a reference electrode, and/or by determining a concentration of chromium and manganese through an instrumental analysis technique such as atomic absorption spectrometry (AAS) or inductively coupled plasma (ICP) mass spectrometry.

The anion exchange material may be an anion exchange resin. Preferably, the anion exchange material is an anion exchange resin which is employed during power generating operation of the nuclear facility.

In a preferred embodiment, the anion exchange material is an inorganic anion exchange material. Use of an inorganic anion exchange material is advantageous in that it is resistant to harsh oxidizing conditions and chemically stable over long disposal times.

More preferably, the anion exchange material has an affinity to the Cr(VI) compound which is higher than an affinity to permanganate. More preferably, the affinity of the anion exchange material to the Cr(VI) compound is at least between five to ten times higher than the affinity to permanganate. The higher affinity towards the Cr(VI) compound makes possible to separate the Cr(VI) compound from the permanganate oxidant during the course of the first cleaning step.

The first cleaning step can be started when the oxidation step is terminated, that is when no further increase of the Cr(VI) concentration in the oxidation solution can be determined.

According to a preferred embodiment, however, the first cleaning step is started already during the oxidation step. Preferably, the aqueous oxidation solution containing the Cr(VI) compound and the permanganate oxidant is passed over the anion exchange material preferably before the chromium concentration has stabilized in the oxidation solution, i.e. while the chromium concentration is still increasing. Accordingly, the oxidation step and the first cleaning step are at least partially conducted simultaneously. This can be used to achieve additional time savings.

More preferably, an amount of the Cr(VI) compound in the oxidation solution is determined, and the amount of anion exchange material used in the first cleaning step is controlled on the basis of the amount of the Cr(VI) compound determined in the oxidation solution. Still more preferably, the amount of the anion exchange material is controlled so as to substantially immobilize the Cr(VI) compound only, and retain at least part of, or substantially all of, the permanganate oxidant in the oxidation solution. Using slightly less of the anion exchange material than required for bonding all of the Cr(VI) compound contained in the oxidation solution guarantees that the permanganate oxidant is not removed from the oxidation solution. Due to the higher affinity of the anion exchange material to the Cr(VI) compound, any permanganate initially captured on the anion exchange material is displaced by the Cr(VI) compound when it passes the anion exchange material. Therefore, the Cr(VI) compound is selectively removed from the oxidation solution while a concentration of the permanganate oxidant in the oxidation solution remains sufficiently high to further oxidize the metal oxide layer. Most preferably, the amount of the anion exchange material is controlled so as to immobilize about 80-95 weight percent, preferably 85 to 100 weight percent, of the Cr(VI) compound contained in the oxidation solution.

The permanganate oxidant is preferably removed from the oxidation solution after immobilizing of the Cr(VI) compound by immobilizing on an anion exchange material, before commencing the decomposition step.

According to a further preferred embodiment, the first cleaning step is started when the oxidation step is terminated and the permanganate oxidant is removed substantially completely from the oxidation solution. In this embodiment, the oxidation solution containing the Cr(VI) compound is passed over the anion exchange material after complete removal of the permanganate oxidant.

Preferably, complete removal of the permanganate oxidant is effected by reacting permanganate with a stoichiometric or under-stoichiometric amount of a reducing agent without changing the oxidation state of the Cr(VI) compound. The reducing agent can be an inorganic or an organic reducing agent.

More preferably, the reducing agent is a compound that does not release any metal cations when being reacted with the permanganate oxidant. Still more preferably, the reducing agent is selected from the group consisting of hydrogen, hydrogen peroxide, hydrazine, non-chelating monocarboxylic acids, non-chelating dicarboxylic acids, and derivatives thereof.

According to an alternative embodiment, the reducing agent comprises a metal cation which changes its oxidation state when reacted with permanganate, and more preferably a cation selected from the group consisting of iron(II) and chromium(III). This embodiment is less preferred because additional waste is generated.

Complete removal of the permanganate oxidant can also be effected by means of electrochemical reduction using an electrode or other electrochemical means.

The above described reducing agents and/or electrochemical reduction can also be used for removing the permanganate oxidant from the oxidant solution after immobilizing of the Cr(VI) compound on an anion exchange material, before commencing the decomposition step. Preferably, however, the oxidation solution containing the Cr(VI) compound is not contacted with any organic acid prior to the subsequent decontamination step.

In a further preferred embodiment, the anion exchange material used to remove the Cr(VI) compound and/or the permanganate oxidant is never exposed to an organic acid solution, neither in the first cleaning step, nor in a subsequent step of the decontamination treatment.

An exposure of the anion exchange material to an organic acid would wash down manganese from the material. In addition, chromium would be washed down from the anion exchange material and additionally form a chromium chelate complex, which is to be avoided. Therefore, the anion exchange material used in the first cleaning step preferably is either discarded directly after its use, or any process solution containing organic acid is prevented from flowing through the anion exchange material used in the first cleaning step by appropriate valve positioning in the decontamination circuit, so that use of the anion exchange material can be resumed in a posterior treatment cycle if its capacity has not yet been exhausted.

Further, preventing the anion exchange material from being exposed to the organic acid facilitates and/or enables the use of inorganic anion exchange materials. These materials are suitable for the first cleaning step of the present invention, but have not been employed for any reported chemical decontamination application due to their general incompatibility with organic acids used in the decontamination step.

As soon as the removal of the Cr(VI) compound is completed or the concentration of the Cr(VI) compound is below a predetermined target value, the decontamination step is started.

Decontamination Step

In the decontamination step, the metal oxide layer subjected to the oxidation step is contacted with an aqueous solution of an organic acid. The organic acid serves as a decontamination reagent and reacts with the metal oxides and radioactive matter incorporated in the metal oxide layer, thereby forming a decontamination solution containing the decontamination reagent, one or more metal ions dissolved from the metal oxide layer, and the radioactive matter.

Preferably, the organic acid is an organic acid that can be treated in situ at a later stage to minimize or completely eliminate the waste volume associated to it.

According to a further preferred embodiment, the organic acid used in the decontamination step is selected from the group consisting of monocarboxylic acids such as formic acid and glyoxylic acid, aliphatic dicarboxylic acids such as oxalic acid, alkali metal salts of monocarboxylic acids and aliphatic dicarboxylic acids, and mixtures thereof.

More preferably, the organic acid is an aliphatic dicarboxylic acid selected from linear aliphatic dicarboxylic acids having 2 to 6 carbon atoms. Most preferably, the organic acid is oxalic acid.

The decontamination step further comprises passing the decontamination solution over a cation exchange material to immobilize the metal ions and the radioisotopes dissolved therein. During this step, all cations dissolved in the decontamination solution, including Mn(II) generated from the decomposition products of the permanganate oxidant consumed during the oxidation step as well as the radioisotopes dissolved in the decontamination solution, are removed from the decontamination solution and are permanently captured on the cation exchange material.

The cation exchange material may be a cation exchange resin of the type employed in the nuclear power plant during power generating operation, or any other suitable cation exchange material. Preferably, the cation exchange material used in the decontamination step is a cation exchange resin which is present in the water clean-up system of the nuclear reactor.

The organic acid dissolved in the decontamination solution is regenerated by release of hydrogen ions during the cation exchange reaction. Therefore, the organic acid is not depleted in the decontamination step, and can be used continuously for dissolution of the metal oxide layer.

Accordingly, it is possible to employing sub-stoichiometric amounts of the organic acid. The decontamination of the metal surface covered with the metal oxide layer is only limited by a decrease of the solubility of the metal oxide layer which is due to the fact that the metal oxide layer reacted in the oxidation step is completely removed at the end of the decontamination step. Therefore, a further oxidation of the remaining metal oxide layer is often required to dissolve additional metal ions from the metal oxide layer into the decontamination solution.

The progress of the decontamination step and the cation exchange reaction can be monitored by measuring the concentration of selected radioisotopes and metal ions. Samples can be taken from the decontamination solution and analyzed by spectroscopic methods such as atomic absorption spectroscopy (AAS) and inductively coupled plasma (ICP) mass spectrometry. The amount of radioisotopes dissolved in the decontamination solution can be determined by different methods of gamma spectroscopy, such as by means of high purity germanium detectors, sodium iodide detectors, or by other suitable methods depending on the nature of the radioisotopes present.

The decontamination step is terminated as soon as no substantial increase of the amount of metal ions removed from the decontamination solution and immobilized on the cation exchange material is determined, and/or no further increase of the activity of the radioisotopes immobilized at the ion exchange materials can be measured.

Second (Intermediate or Final) Cleaning Step

Before starting a further oxidation step to solubilize the metal oxide layer now exposed by the decontamination solution, the organic acid must be removed from the decontamination solution.

For example, the system can be drained and rinsed with additional water until the organic acid is completely removed. However, this is the least favored option, because it would generate a large amount of radioactive liquid waste. The water would have to be treated at a later stage in such a way that no chelates are generated.

The organic acid can also be removed by ion exchange mechanisms, but this would generate undesired chelate-containing waste.

According to another option, the organic acid can be removed from the decontamination solution by reacting the organic acid with permanganic acid or another permanganate or oxidizing compound. The process of decomposing the organic acid by reacting with permanganate can preferably be used for decontamination systems having small volumes, e.g. during the decontamination of isolated heat exchangers and the like. However, this reaction requires a substantial amount of permanganic acid or other permanganate compound and also generates additional secondary waste in the form of e.g. manganese ions that have to be removed from the solution via ion exchange, in a way comparable to the other metal cations generated from the metal oxide layer.

Therefore, the preferred embodiment of the decontamination method comprises a decomposition step using another method for the reduction of the organic acid present in the decontamination solution, such as photocatalytical oxidation of the organic acid.

An oxidation of the organic acid itself, photocatalytically or otherwise, does not necessarily generate additional radioactive waste since the decomposition of the organic matter results in the formation of water and carbon dioxide. Therefore, selecting an appropriate decomposition method makes it possible to avoid the formation of any unnecessary secondary radioactive waste in this stage.

According to a preferred embodiment, the organic acid is reacted with an oxidant that does not contribute to the amount of radioactive waste generated during the decontamination process. Preferably, the organic acid is decomposed to form carbon dioxide and water. More preferably, the organic acid is decomposed by reacting the organic acid with an oxidant such as hydrogen peroxide, most preferably while simultaneously exposing the decontamination solution to UV radiation.

Use of hydrogen peroxide is advantageous because it is an industrial chemical which is commercially available and can be stored in stock solutions at the nuclear plant facilities. Oxygen or ozone could also be used for decomposing the organic acid, but are less preferred because these oxidants require additional equipment and are associated with other risks, especially in the case of ozone. Preferably, a photocatalytical oxidation is employed to increase the reaction speed.

Preferably, the temperature of the decontamination solution during decomposition of the organic acid is kept between 20 and 95° C.

A UV reactor is preferably immersed into the decontamination solution to maximize the area of exposure to UV light, and hydrogen peroxide is injected into the decontamination solution upstream of the UV reactor such that the hydrogen peroxide is thoroughly mixed with the decontamination solution prior to reaching the UV reactor.

The injection of hydrogen peroxide into the decontamination solution is preferably controlled so that no hydrogen peroxide is determined downstream of the UV reactor.

Preferably, hydrogen peroxide downstream of the UV reactor is monitored continuously, and the rate of the hydrogen peroxide injection is adjusted accordingly.

Through the application of the invention, the duration of the decomposition step can be reduced when compared with the prior art. This is a consequence of the significantly lower amount of chromium complexes present in solution. In the prior art decontamination process both, chromium released during the oxidation phase and chromium released during dissolution of the metal oxide layer in the decontamination step, are commonly present at this stage. According to the invention, only chromium compounds released from the metal oxide layer during the decontamination step are present in the process solution at the time of the decomposition of the organic acid.

The decomposition of the organic acid is preferably terminated if the decontamination solution is completely depleted of the organic acid, including the organic acid bound in chelate complexes. While less preferred, but also possible depending on project objectives and local specific considerations, the decontamination solution can be depleted to a concentration of the free organic acid in the solution of up to 50 mg/kg or less. Higher concentrations of free organic acid are also possible but even less preferable, due to an increase of permanganate consumption in a subsequent treatment cycle.

Chromate resulting from the decomposition of the organic acid and any chromium complexes still present in the decontamination solution after the decomposition of the organic acid, such as Cr(III) oxalate complexes, are preferably carried to the next oxidation step. In the oxidation step, any remaining amount of the chelating organic acid, if present, is decomposed by the action of the permanganate oxidant, and eventually remaining Cr(III) compounds are oxidized to form Cr(VI) compounds. Thus, no organic acid or other chelating agent is transferred to the ion exchange material waste as a result of the second cleaning step.

In a final cleaning step, when the metal oxide layer is completely removed from the metal surface and/or the desired decontamination factor is achieved, the conductivity of the primary coolant may be controlled to be 10 μS/cm at 25° C. or lower, although final water quality criteria can vary from facility to facility. Preferably, the final cleaning step is conducted at a temperature of 70° C. or less, more preferably 60° C. or less.

The second cleaning step may already be started during the decontamination step. The decontamination solution is then passed over a cation exchange resin while the organic acid is simultaneously decomposed, for instance by photocatalytic oxidation.

The removal of the metal ions and radioisotopes in the second cleaning step and/or the decontamination step may take place in a bypass conduit in the low-pressure part of the reactor, most preferably using cation exchange columns present in the water cleaning system of the nuclear reactor. It is also possible to operate external ion exchange modules, alone or in parallel to the ion exchange columns of the reactor water cleaning system.

The oxidation step, the first cleaning step, the decontamination step and the second cleaning step will form a decontamination treatment cycle. These steps may optionally be repeated so that the decontamination method may comprise two or more decontamination treatment cycles, preferably two to five treatment cycles. It has been found that a satisfactory decontamination factor can be achieved with this number of treatment cycles in full system decontamination and/or decontamination of subsystems or components of a pressurized water reactor. However, the number of decontamination treatment cycles is not limited to the numbers given above, but may also depend on the reactor design, the level of radioactive contamination and the decontamination objectives.

The decontamination method of the present invention is preferably applied to the decontamination of the primary coolant circuit of a nuclear reactor. The primary coolant circuit is provided for cooling of the reactor core including the fuel bundles and for transferring the hot coolant to the steam generator where energy is transferred from the primary coolant to a secondary cooling circuit passing through the steam generator.

Calculations have been performed on a full system contamination of a primary coolant system having a system volume of 360 $m^3$, and using oxalic acid as the organic acid and conventional anion exchange resin such as the one used during operation of a nuclear power plants as the sole anion exchange material during 5 decontamination treatment cycles. The calculations show that the resin consumption for capturing chromium and additional manganese spent for oxidizing residual chromium oxalate in the oxidation step, according to the present invention, will result in a consumption of about 1560 liters of conventional anion exchange resin and about 1400 liters of conventional cation exchange resin, adding to a total of about 2960 liters of spent conventional waste resin. A decontamination treatment of the same system using a commercial prior art process would result in a consumption of about 4460 liters of conventional anion exchange resin for capturing chromium oxalate at the cleaning step. Thus, the waste savings amount to a total of about 1500 liters of conventional ion exchange resins to be used in the decontamination process corresponding to waste savings of about 34 percent in volume. In addition, since the spent anion exchange resin is free of chelating agents, disposal of the resin is significantly simplified, or even made only possible through the application of this method.

Although the invention is illustrated and described herein as embodied in a method for surface decontamination, it is not intended to be limited to the details shown, since various modifications and structural changes may be made therein without departing from the scope of the appended claims.

The invention claimed is:

1. A method for decontaminating a metal surface exposed to radioactive liquid or gas during operation of a nuclear facility, wherein the metal surface is covered with a metal oxide layer including chromium and radioactive matter, the method comprising:

a) an oxidation step wherein the metal oxide layer is contacted with an aqueous oxidation solution for converting chromium into a Cr(VI) compound and dissolving the Cr(VI) compound in the oxidation solution, wherein the aqueous oxidation solution comprises a permanganate oxidant but no additional mineral acid;

b) a first cleaning step wherein the oxidation solution containing the Cr(VI) compound is passed directly over an anion exchange material and the Cr(VI) compound is immobilized on the anion exchange material;

c) a decontamination step following the first cleaning step wherein the metal oxide layer subjected to the oxidation step is contacted with an aqueous solution of an organic acid for dissolving the metal oxide layer, thereby forming a decontamination solution containing the organic acid, metal ions and radioactive matter, and wherein the decontamination solution is passed over a cation exchange material for immobilizing the metal ions and radioactive matter;

d) a second cleaning step wherein the organic acid contained in the decontamination solution is decomposed; and e) optionally repeating steps a) to d).

2. The method of claim 1, wherein a progress of the oxidation step is monitored by controlling the amount of the permanganate oxidant remaining in the oxidation solution, and/or by monitoring a concentration of the Cr(VI) compound dissolved in the oxidation solution.

3. The method of claim 1, wherein the anion exchange material is contained within an external module configured for charge and discharge of different amounts of the anion exchange material.

4. The method of claim 1, wherein the first cleaning step is controlled by monitoring a removal of the Cr(VI) compound and/or the permanganate oxidant from the oxidation solution.

5. The method of claim 1, wherein the anion exchange material is an inorganic anion exchange material.

6. The method of claim 1, wherein the anion exchange material has an affinity to the Cr(VI) compound which is higher than an affinity to the permanganate oxidant.

7. The method of claim 1, wherein the permanganate oxidant is removed from the oxidation solution by immobilizing on an anion exchange material.

8. The method of claim 1, wherein the first cleaning step is started during the oxidation step.

9. The method of claim 1, wherein an amount of the Cr(VI) compound in the oxidation solution is determined, and an amount of anion exchange material used in the first cleaning step is controlled on the basis of the amount of Cr(VI) compound determined in the oxidation solution.

10. The method of claim 9, wherein the amount of the anion exchange material is controlled so as to substantially immobilize the Cr(VI) compound only and to retain at least part of, or substantially all of, the permanganate oxidant in the oxidation solution.

11. The method of claim 1, wherein the first cleaning step is started when the oxidation step is terminated, and wherein the permanganate oxidant is removed from the oxidation solution prior to the first cleaning step.

12. The method of claim 11, wherein the permanganate oxidant is removed from the oxidation solution by reacting the permanganate oxidant with a stoichiometric or substoichiometric amount of a reducing agent without changing the oxidation state of the Cr(VI) compound.

13. The method of claim 11, wherein the permanganate oxidant is removed from the oxidation solution by means of electrochemical reduction.

14. The method of claim 1, wherein the oxidation solution containing the Cr(VI) compound is not contacted with an organic acid prior to the decontamination step.

15. The method of claim 1, wherein the anion exchange material used to immobilize the Cr(VI) compound and/or the permanganate oxidant is never exposed to an organic acid solution.

16. The method of claim 1, wherein the decontamination solution after decomposition of the organic acid in the second cleaning step includes an amount of a chromium complex, and the chromium complex is carried to the oxidation step of a subsequent decontamination cycle.

17. The method of claim 6, wherein the affinity of the anion exchange material to the Cr(VI) compound is between five to ten times higher than the affinity to the permanganate oxidant.

18. The method of claim 7, wherein the permanganate oxidant is removed from the oxidation solution by immobilizing on an anion exchange material after immobilizing of the Cr(VI) compound.

19. The method of claim 8, wherein the aqueous oxidation solution containing the Cr(VI) compound and the permanganate oxidant is passed over the anion exchange material before a concentration of the Cr(VI) compound has stabilized in the oxidation solution.

20. The method of claim 12, wherein the reducing agent is a compound that does not release any metal cations when being reacted with the permanganate oxidant.

21. The method of claim 12, wherein the reducing agent is selected from the group consisting of hydrogen, hydrogen peroxide, hydrazine, monocarboxylic acids, dicarboxylic acids, and derivatives thereof.

* * * * *